US005626112A

United States Patent [19]

Liao

[11] Patent Number: 5,626,112

[45] Date of Patent: May 6, 1997

[54] AIR-INLET ASSISTOR FOR A VEHICLE ENGINE

[76] Inventor: Chun-Yao Liao, No.159, Lane 247, Ta Chiao first St., Yung Kang City, Tainan Hsien, Taiwan

[21] Appl. No.: 538,000

[22] Filed: Oct. 2, 1995

[51] Int. Cl.[6] ..... F02M 3/00

[52] U.S. Cl. ..... 123/184.21; 123/198 E

[58] Field of Search ..... 123/198 R, 198 E, 123/184.21, 184.53

[56] References Cited

U.S. PATENT DOCUMENTS

| | | | |
|---|---|---|---|
| 4,412,517 | 11/1983 | Kobashi et al. | 123/588 |
| 4,414,942 | 11/1983 | Itoh et al. | 123/588 |
| 4,417,553 | 11/1983 | Ohkawa et al. | 123/585 |
| 5,460,148 | 10/1995 | Suzumura et al. | 123/585 |

*Primary Examiner*—David A. Okonsky
*Attorney, Agent, or Firm*—Morton J. Rosenberg; David I. Klein

[57] ABSTRACT

An air-inlet assistor for vehicle engines is provided which connects to the engine with an inlet pipe. The air-inlet assistor includes a main body, an upper magnet and a lower magnet contained within the main body, and an air cleaner. The inner cavity of the main body is divided into an upper working chamber and a lower inlet chamber. The upper and lower magnets are disposed within the working chamber with like poles thereof being face to face, to generate a repelling force therebetween. An inverted cone is disposed on the bottom side of the lower magnet to seal an opening formed between the working chamber and the inlet chamber. When the engine is started, a drawing in force generated by vacuum in the engine makes the upper and lower magnets move together to break the seal in the opening formed in a partition board that separates the two chambers. The outside air can then flow through the air cleaner into the inlet chamber, pass through the openings in the partition board into the working chamber and flow through the inlet pipe to get to the engine, for automatically maintaining the balance of the air-inlet.

1 Claim, 4 Drawing Sheets

AIR-INLET ASSISTOR FOR A VEHICLE ENGINE

BACKGROUND OF THE INVENTION

1. Field of the Invention

The present invention relates to an air-inlet assistor for a vehicle engine. More particularly, the present invention is directed to a system for automatically keeping the air supply for an engine balanced.

2. Prior Art

In accordance with the operational principles of conventional vehicle engines, and with reference to FIG. 4, the amount of fresh air from the outside passing through the air cleaner 53 for supplying the running engine is dependent on the drawing in force of the inlet manifold 52 through the carburetor 51. The inlet pipe 54 is connected to the base stand 55 that is attached to the air cleaner 63, the inlet pipe being connected through an inlet valve 56 and a back valve 57, to form an air-inlet assistor for improving the full burning of fuel in the engine. The base stand 55 has a cubic shape and there is an L or S shaped channel passing through it, with one end connecting to the air cleaner 53 for cleaning the air, and the other end being connected to the inlet valve 56. The outlet of the back valve 57 is connected to the carburetor 51 of the engine 5. So when starting the engine, the drawing in force created in the inlet manifold 52 can draw the air into the engine 5 for burning the fuel.

Accordingly, the above-mentioned air-inlet controlling device has the following shortcomings:

1. The conventional air-inlet assistor cannot be adjusted automatically. If the user finds the air-inlet not providing sufficient air, so as to influence running, he would drive to the garage and leave it to a technician. Therefore, it is not convenient for the user.
2. Adjustment of the conventional device is by manually changing the opening of the inlet valve, causing an additional factor that may influence the intake of air. It too much air is drawn, a mono-cylinder effect can be generated, resulting in a shaking of the vehicle. If the adjustment is in the opposite direction, the burning of fuel in the engine may be incomplete, increasing the waste of gas and adding to atmospheric pollution.
3. Due to the many shortcomings of the conventional device, its production costs are increased. Also, special technicians are needed to install it, making it not practical for high volume production.

An object of the present invention is to provide an air-inlet assistor that can automatically adjust the air-inlet accurately, according to the vehicle, the engine, the differences in the drawing in force from the inlet manifold of the engine, and the different working state of the engine, to avoid the intake of air that is greater or less than needed, thereby keeping the engine running smoothly.

SUMMARY OF THE INVENTION

The present invention provides an assistor to meet the above-mentioned object. The present invention includes a main body, an upper magnet, a lower magnet, and an air cleaner. The upper and lower magnets are arranged with like poles facing each other in the interior of said main body, generating a repelling force to separate the magnets by an exact interval. The magnets work as a floating piston of a valve. When starting the engine and the drawing in force is formed in the inlet pipe, the magnets can be moved up together for directing the air passing through the air cleaner to be sent into the engine to mix with the fuel.

BRIEF DESCRIPTION OF THE DRAWINGS

FIG. I is a side view of the present invention.

DESCRIPTION OF THE PREFERRED EMBODIMENT

Figure 1:
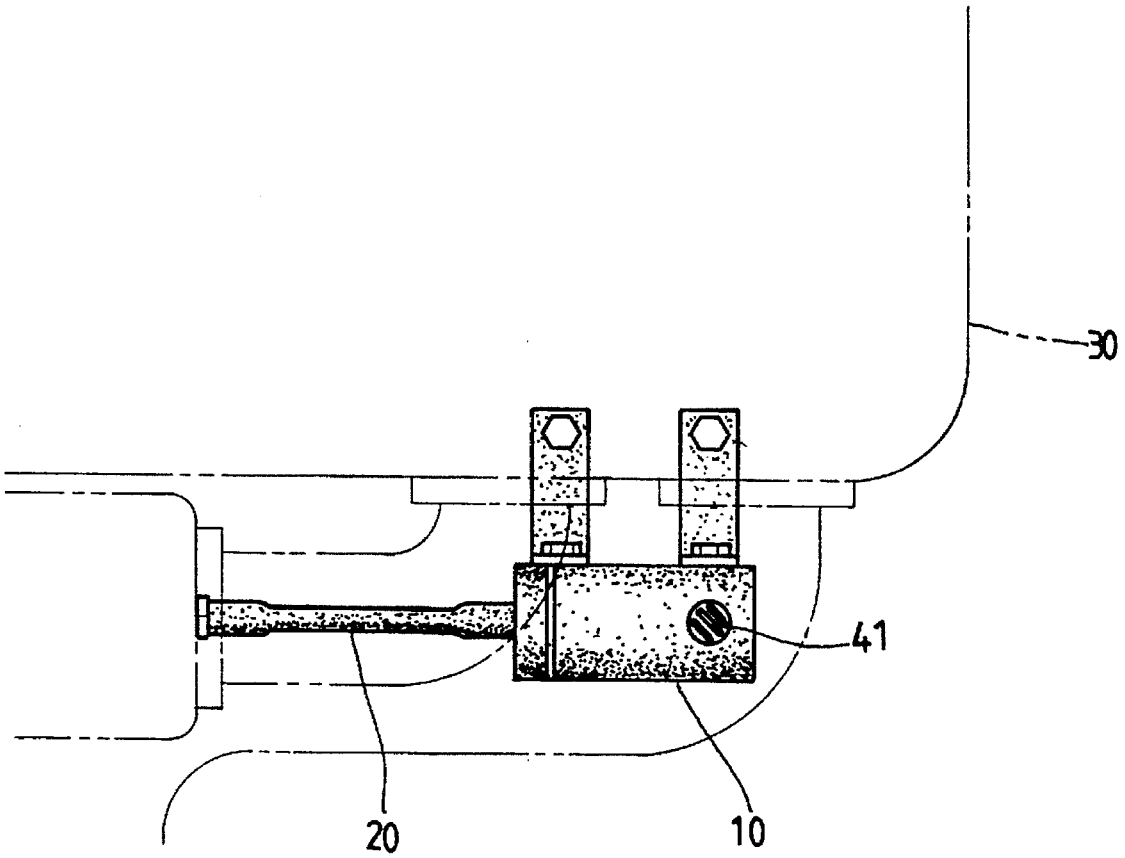
Figure 2:
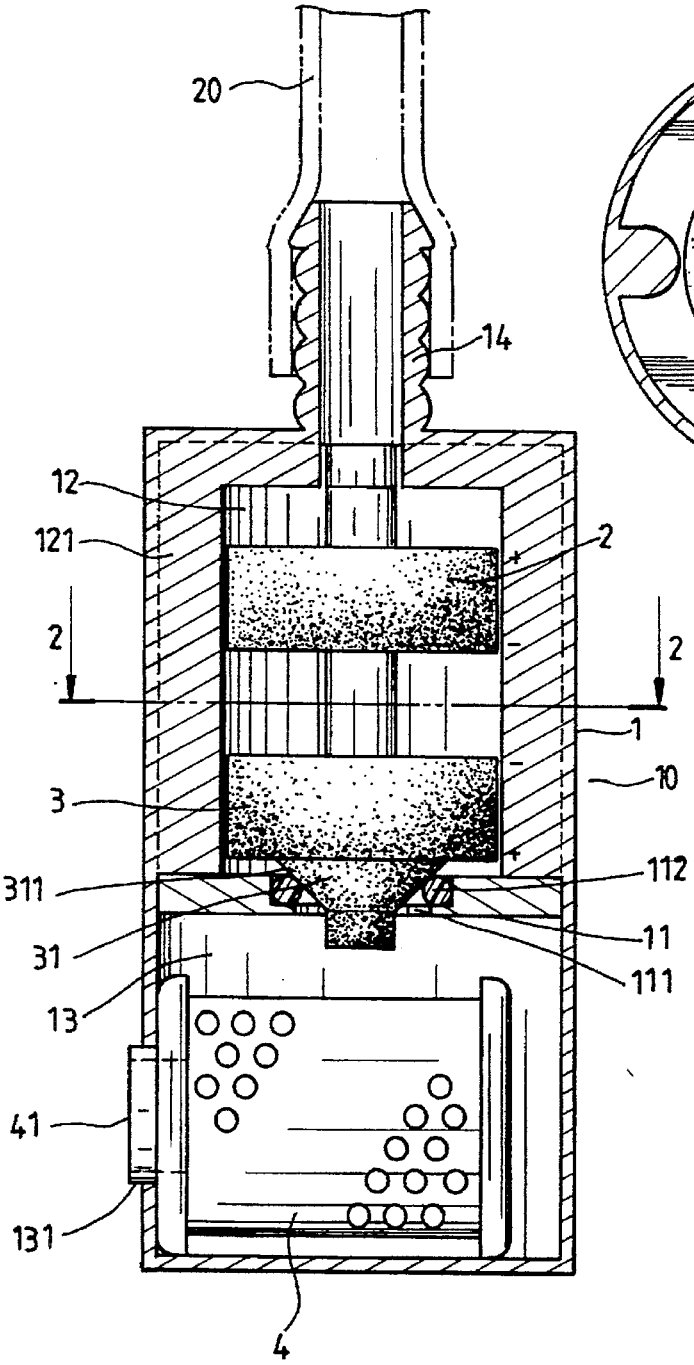
FIG. 2 is a longitudinal cross-sectional view of the present invention.
Figure 2A:
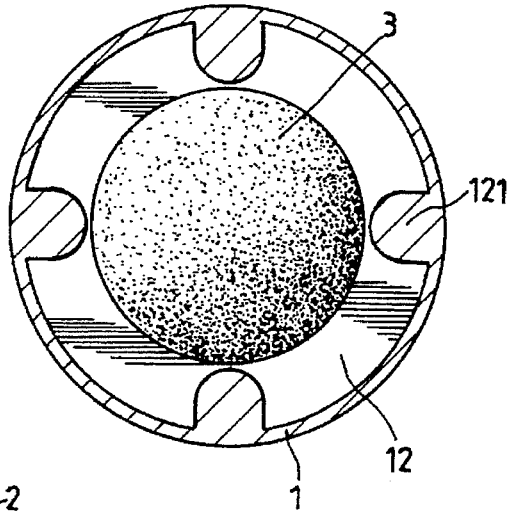
FIG. 2A is a cross-sectional view of the present invention taken along the section line 2—2 of FIG. 2.

Referring to FIG. 1, there is shown, an air-inlet assistor 10 which connects to an inlet pipe 20 and is fastened on the outside wall of the engine 30. With further reference to FIG. 2, it is seen that the air-inlet assistor 10 includes a main body 1, an upper magnet 2, a lower magnet 3 and air cleaner 4.

The main body 1 is a hollow sealed cylindrical container. The main body 1 has a partition board 11 having a counter bore 111 for receiving an O-ring 112 therein. The partition board 11 divides the inner cavity of the main body into two chambers, an upper working chamber 12 and lower inlet chamber 13. The upper working chamber 12 of the container has inverted L-shaped guide bars 121 formed on the side wall. A connection 14 is formed on the top of the main body 1 and extends to the outside for connecting with an inlet pipe 20. The lower inlet chamber 13 has a hole 131 formed through the side wall thereof.

The upper magnet 2 is shaped as a round plate that can be placed into the upper working chamber 12 between the guide bars 121. The top and bottom sides of magnet 2 define the N-pole and S-pole respectively.

The lower magnet 3, disposed below the magnet 2, is shaped as a round plate and there is an inverted cone 31 formed on the bottom side of the magnet for insertion into the counter bore 111 of the partition board 11. A bevel face 311 of cone 31 seals against the O-ring 121. The poles of the two magnets are arranged so that the opposing faces thereof are poled the same to generate a repelling force therebetween.

An air cleaner 4 is located in the lower inlet chamber 13 of the main body 1. The inlet vent 41 of air cleaner 4 is connected with the hole 131 on the side wall of the lower inlet chamber 13 and opens to the outside. When the engine 30 is not starting, the inlet assistor is in closed state, as shown in FIG. 2. Because of the repelling force generated by the like poles of the upper and lower magnets 2 and 3 facing each other, an exact interval is maintained between them. The lower magnet 3 is in contact with the partition board 11 and its bevel face 311 seals against the O-ring 112 in the counter bore 111, to cut off the working chamber 12 from the inlet chamber 13. Thus, air cannot enter into the working chamber 12 of the main body 1. Further, air cannot enter into the engine 30, the air remains in the engine 30 and the inlet pipe 20.

Figure 3:
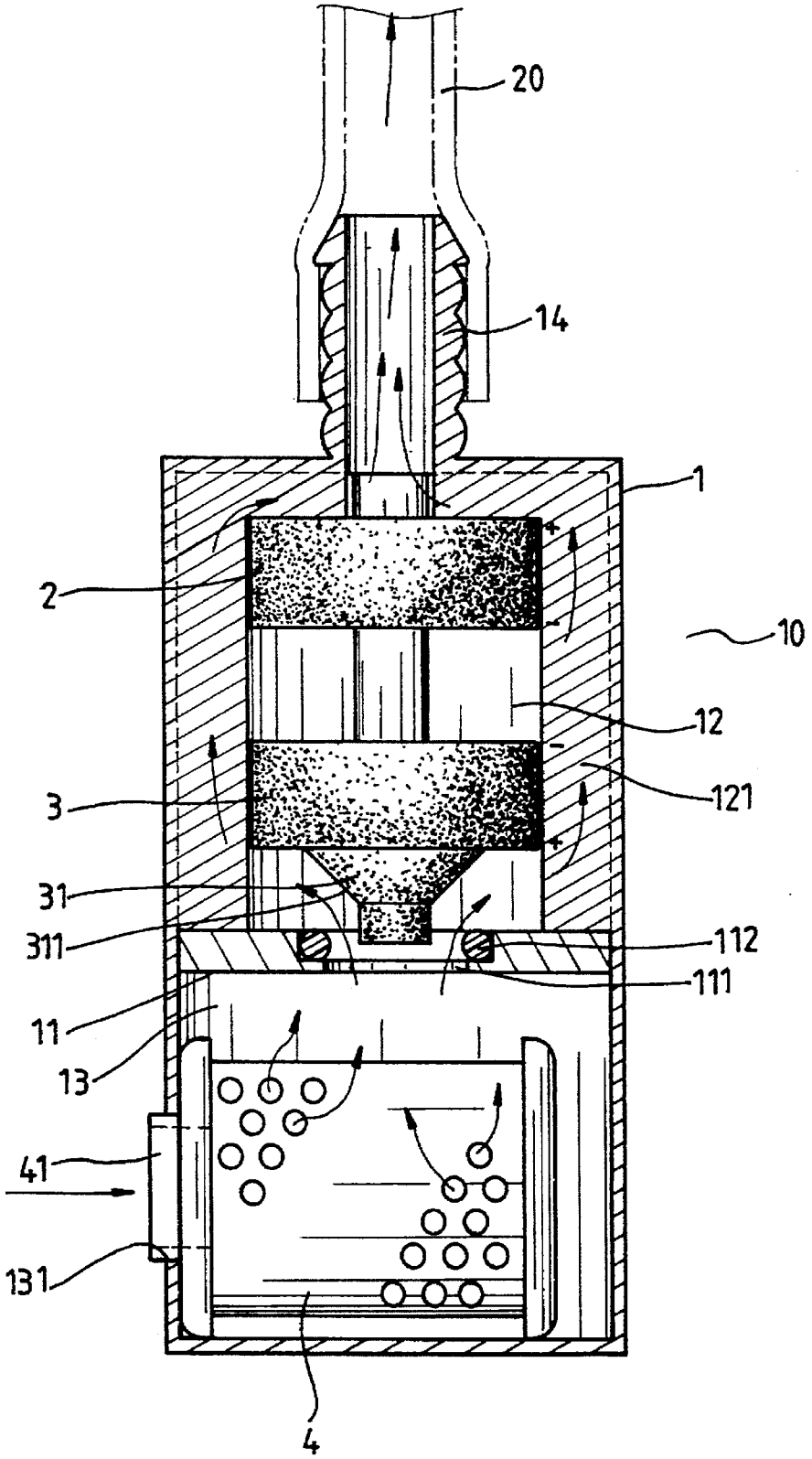
FIG. 3 is a longitudinal cross-sectional view showing operation of the present invention.
Figure 4:
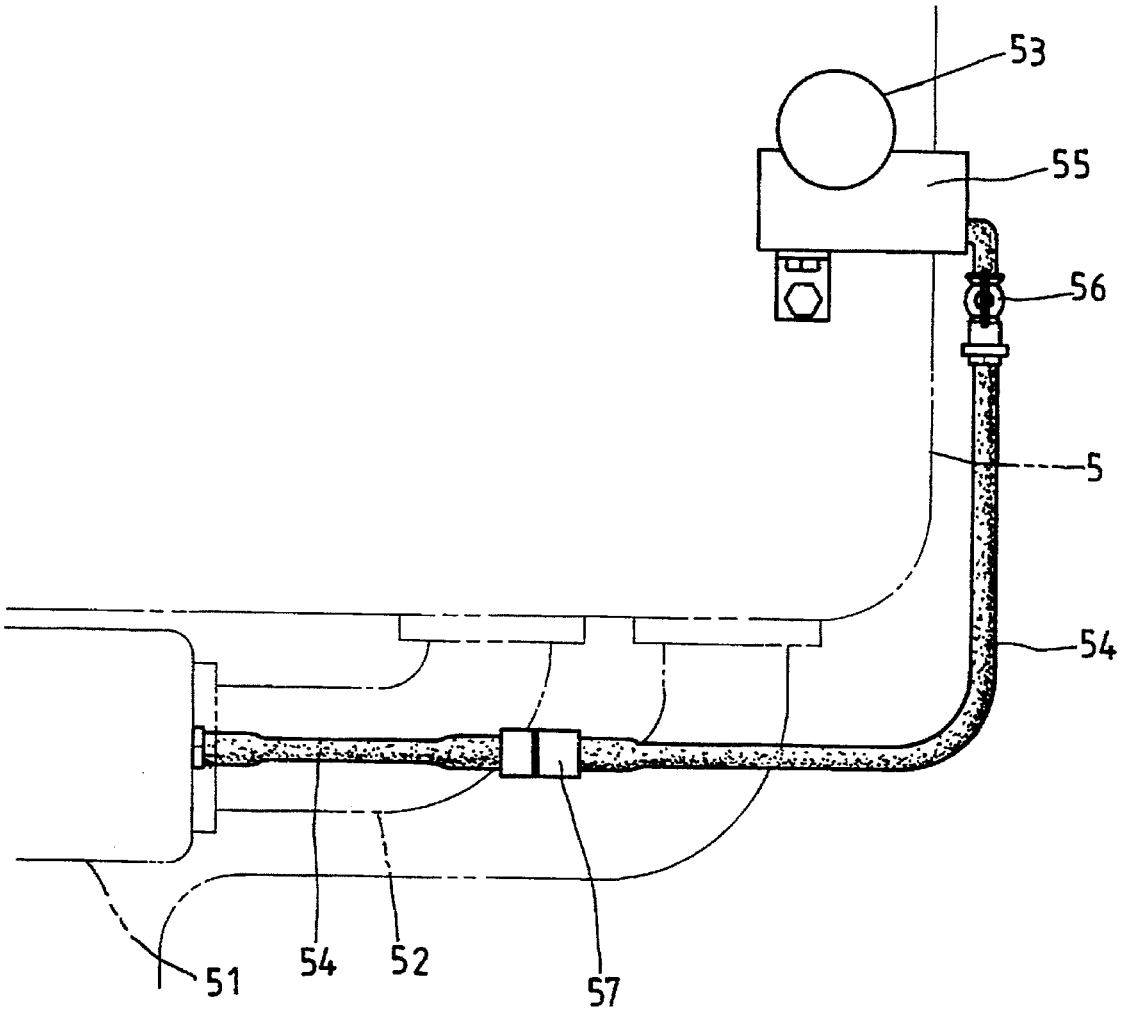
FIG. 4 (PRIOR ART)
FIG. 4 is a side view of a conventional air-inlet assistor.

When starting the engine 30, the air that remained in the engine 30 and the inlet pipe 20 is used at once, generating a vacuum in the engine 30 and the inlet pipe 20 to form a drawing in force, vacuum pressure, which makes the upper and lower magnets 2 and 3 move up together. Meanwhile, the cone 31 of the lower magnet 3 separates from the O-ring 112 on the partition board 11. Therefore, the working chamber 12 opens to the inlet chamber 13, and the outside air, under the drawing in force, passes through the air cleaner 4 into the inlet chamber 13. Then, the air flows through the partition board 11 into the working chamber 12, next flowing into the inlet pipe 20 and into the engine 30 to mix with fuel for burning, as shown in FIG. 3. When the vacuum state has subsided, the upper and lower magnets 2 and 3 resume their original position shown in FIG. 2, providing a repetitive cycle.

I claim:

1. An air-inlet assistor for a vehicle engine, comprising:

a main body formed by a container having a cylindrical wall to define an internal cavity of said main body, said main body having a partition formed therein to divide said internal cavity into a working chamber and an inlet chamber, said partition having an aperture formed therethrough for providing fluid communication between said working chamber and said inlet chamber, said partition having a counter bore formed concentrically about said aperture on a side of said partition facing said working chamber, said working chamber having a plurality of guide bars extending from an internal wall surface disposed in radially spaced relationship and an outlet connection coupled to a vehicle engine for drawing air from said working chamber, said inlet chamber having an opening formed through a portion of said cylindrical wall;

an O-ring disposed within said counter bore;

an air cleaner disposed within said inlet chamber, said air cleaner having an inlet coupled in fluid communication with said inlet chamber opening;

a first magnet having a plate-like contour with a pair of opposing circular end faces, said first magnet being disposed within said working chamber between said plurality of guide bars; and, a second magnet disposed within said working chamber between said plurality of guide bars in longitudinally spaced relationship with said first magnet, said second magnet having a first circular end face directed toward a respective end face of said first magnet and poled for generating a repulsive force therebetween, said second magnet having a second circular end face with an inverted cone extending therefrom for insertion into said partition aperture in sealing engagement with said O-ring, wherein a vacuum communicated from the engine to said outlet connection displaces said first and second magnets to draw ambient air through said air cleaner, said partition aperture and said outlet connection to the engine.

* * * * *